US005408931A

United States Patent [19]

Tallman

[11] Patent Number: 5,408,931

[45] Date of Patent: Apr. 25, 1995

[54] SHOTGUN AMMUNITION

[76] Inventor: Harvey A. Tallman, 331 Daniels Rd., Saratoga, N.Y. 12866

[21] Appl. No.: 131,076

[22] Filed: Oct. 1, 1993

[51] Int. Cl.[6] ..... F42B 5/045

[52] U.S. Cl. ..... 102/439; 102/434; 102/448; 102/501; 102/526

[58] Field of Search ..... 102/430, 434, 439, 448, 102/462, 463, 501, 466, 467, 524, 526

[56] References Cited

U.S. PATENT DOCUMENTS

| | | | |
|---|---|---|---|
| 16,629 | 2/1857 | Newbury | 102/524 |
| 17,792 | 7/1857 | Johns . | |
| 1,518,920 | 12/1924 | Halloran | 102/439 |
| 3,157,121 | 11/1964 | Daubenspeck et al. | 102/466 |
| 3,162,124 | 12/1964 | Miller | 102/466 |
| 3,359,906 | 12/1967 | Herter | 102/466 |
| 3,678,858 | 7/1972 | Herter et al. | 102/463 |
| 4,413,564 | 11/1983 | Brown | 102/501 |
| 4,434,718 | 3/1984 | Kapsch et al. | 102/439 |
| 4,471,699 | 9/1984 | Turco et al. | 102/501 |
| 4,587,905 | 5/1986 | Maki | 102/430 |
| 4,676,169 | 6/1987 | Maki | 102/439 |
| 4,779,535 | 10/1988 | Maki | 102/501 |
| 4,805,535 | 2/1989 | Marcon | 102/439 |
| 4,829,904 | 5/1989 | Sullivan | 102/439 |
| 4,864,934 | 9/1989 | Theising | 102/430 |
| 4,913,056 | 4/1990 | Matysik | 102/439 |
| 5,116,224 | 5/1992 | Kelsey, Jr. | 102/439 |
| 5,133,261 | 7/1992 | Kelsey, Jr. | 102/439 |

FOREIGN PATENT DOCUMENTS

| | | | |
|---|---|---|---|
| 707127 | 4/1965 | Canada | 102/439 |
| 2444181 | 4/1976 | Germany | 102/430 |
| 24314 | of 1902 | United Kingdom | 102/501 |

*Primary Examiner*—Harold J. Tudor
*Attorney, Agent, or Firm*—Schmeiser, Olsen & Watts

[57] ABSTRACT

Ammunition is disclosed for firing a shotgun slug from a rifled shotgun having a range of about 300 meters. The shotgun ammunition comprises a cartridge, propellant, a fiber wad, and a slug. The slug includes a nose having a parabolic cross-section, a frustoconical rotation ring, and the slug has an internal cavity. The increased range enhances a shotgun's use in hunting, military, and police applications.

4 Claims, 1 Drawing Sheet

SHOTGUN AMMUNITION

FIELD OF THE INVENTION

This invention relates generally to improved shotgun ammunition. In particular, this invention relates to a slug having a greatly improved range over which a conventional shotgun projectile can be fired.

BACKGROUND OF THE INVENTION

The use of a shotgun in certain hunting, military, and police applications has been limited in the past because of inadequate range. The best shotgun slugs in the prior art have an accuracy of about a 2 inch drop at a range of 100 yards. The conventional shotgun slug drops about 10 inches in 100 yards. These shotgun slugs, however, are not usable at longer ranges (e.g., 300 meters) because their trajectory decays into the ground at this range. The shotgun ammunition of the present invention solves the difficulty of limited range experienced in the prior art. The shotgun ammunition of the present invention is usable at a range of 300 meters.

In many parts of the country, the hunting of large game, such as deer, is restricted to the use of shotguns. Locales with these types of restrictions are generally densely populated areas where a stray rifle bullet, which can have a range of well over a mile, would endanger human life. Since shot is not practical in large game hunting, there has been a focus in the prior art on developing a shotgun slug having an improved range while still retaining the accuracy necessary for hunting. The present invention improves the range in which a shotgun slug is usable from 100 yards to 300 meters.

Prior art shotgun ammunition have also had limited military application. Shotguns in the military have mainly been used by personnel who have short range requirements such as truck drivers, MPs (military police), and helicopter pilots. Shotguns are advantageous to these individuals, because they are relatively light. The shotgun ammunition of the present invention offers the benefits to these military personnel of a 300 meter range, as well as being able to carry more ammunition. The military presently use 12 gauge shotguns. Ammunition of the present invention can be used in a 0.20 gauge shotgun which is lighter and smaller ammunition than the 0.12 gauge shotgun.

In police applications, a rifle has limited use because of the potential for stray bullets having a range of over a mile. Such a stray bullet would endanger persons in urban settings. The advantage of the present invention is that the shotgun slug has a longer range (300 meters) than the prior art, yet it has a level trajectory that will drop to the ground at about 470 yards. The police presently use a 0.12 gauge shotgun. Ammunition of the present invention can be used in a 0.20 gauge shotgun which is lighter and smaller ammunition than the 0.12 gauge shotgun.

The main focus of the prior art devices has been to improve the range and accuracy of a shotgun slug for use with a smooth barreled rifle. Many of the techniques used in the development of slugs for a smooth barreled shotgun have been applied to a rifled barrel shotgun. For example, one feature of the prior art slugs used in a smooth-bore barrel shotgun is an enlarged outside diameter on the slug. Shotgun slugs having an outside diameter smaller than the bore tended to bounce as they moved through the barrel. This bouncing would effect the aerodynamic stability of the slug as it left the barrel thereby causing an inaccurate trajectory from where the slug was aimed. To improve this inaccuracy, cylindrical slugs having an outside diameter larger than the inside diameter of the barrel were formed with alternate vanes and grooves in the sidewall of the slug. In this vaned/grooved slug, its outside diameter was formed only slightly larger than the barrel to prevent over swagging of the vanes. As the slug moved through the barrel, the grooves allowed for a radially inward swagging action which centered the slug. Such slugs, however, have only been able to obtain a range of 100 yards with an accuracy of a 2 inch drop.

Another slug, which was formed for a rifled barrel, included a plastic sabot. The plastic sabot is a jacket that fits around the bore and spins the slug as it passes through the rifling of the barrel upon firing. The plastic sabot is usually disintegrated or falls off during firing.

SUMMARY OF THE INVENTION

The present invention combines features that enhance the range of a rifled shotgun slug to 300 meters while still retaining adequate accuracy for applications in hunting, military and police operations. The present invention has a combination of features which are all important to produce ammunition having a greater range than the conventional shotgun ammunition. As will be hereinafter discussed, the type of powder, wad, crimp, slug, and case are all important features for obtaining a range of 300 meters.

In assembled form, the case or cartridge is loaded with a slow burning shotgun flake powder, SR4756. SR4756, manufactured by IMR Corp. (Improved Military Rifle), has a relative quickness of 305 based on IMR's burn rate scale. Relative quickness is a scale devised to measure the burn rate of different powders. A slow burning flake shotgun powder is important to ensure that the majority of the powder will burn inside the case, yet is slow enough to ease the slug into the set up of the barrel. Thereafter, the burning continues down the full length of the barrel for increased velocity. In a conventional shotgun, the powder ceases burning after penetrating about 14 inches into the barrel. Testing has shown that the slug of the present invention exiting a 20 inch shotgun barrel has a velocity of 850 ft/sec and will have a 3 ft. drop at 300 meters. A slug coming from a 25 inch barrel has a 1250 ft/sec velocity and will only drop 1 ft. at 300 meters. Such a difference in velocity suggests that the powder is still burning as it exits the 20 inch barrel. Exit velocities may be varied from 850 ft/sec. to 1350 ft/sec. depending upon barrel length, powder, wad type, etc.

A slow burning shotgun powder ensures slow movement of the slug into the setup. A quick powder, however, may be used after the slug is in the set up of the barrel. It is contemplated that a plurality of powders may be used in the same cartridge. A slow burning powder may be used to position the slug is in the set up of the barrel. A quick burning powder may then be lit to increase the velocity of the slug down the barrel. Such embodiment could be made by placing powders with different burn rates in separate chambers in the cartridge.

The wad used in the present invention is made from fiber. A fiber wad produces the proper amount of cushioning effect from the expansion of gas produced by the slow burning powder to ease the slug out of the cartridge. A wad made from a different material having greater resilience, such as rubber, may be used with a faster burning powder. A greater resilience is desirable to absorb more shock from the greater pressure caused by a faster expansion of the resultant gases. It is within the scope of this invention to conceive of other powder/wad combinations, wherein there is a tradeoff of resilience for burn speed.

The eight-star crimp of the present invention is important for centering and for release pressure. Release pressure is the pressure at which the slug is released from the cartridge. An eight-star crimp centers the slug coming out of the cartridge or case. A rolled crimp does not have a good centering effect and also results in too great of a release pressure. For this reason, an eight-star crimp is used. Other crimps having similar centering properties and release pressures may be used, such as a six-star crimp.

The slug shape is important for positioning in the set up of the barrel, for engaging the rifling of the barrel, and for increasing aerodynamic properties in flight. For positioning or centering in the barrel, the slug of the present invention has a rounded nose and a smooth frustoconical rotation ring. The smooth rotation ring is used for engaging the rifling of the barrel to produce a spin in flight. The rounded nose of the slug is used for increasing aerodynamic properties by decreasing drag, thereby prolonging the flight trajectory.

Another feature of the present invention is the type of cartridge casing or hull used. Instead of a conventional shotgun hull, a skeet hull is used. The conventional shotgun hull is designed for high pressure loadings, whereas the skeet hull is designed for low pressure loadings.

BRIEF DESCRIPTION OF THE DRAWINGS

The character of the invention may be best understood by reference to one of its structural forms, as illustrated by the accompanying drawings.

DETAILED DESCRIPTION OF THE PREFERRED EMBODIMENT

Figure 1:
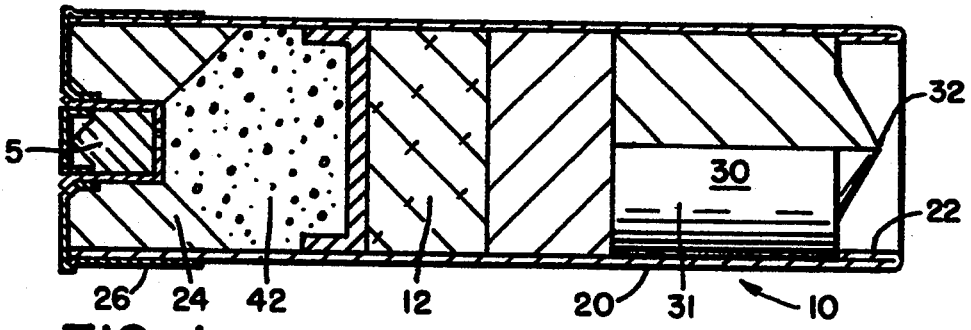
FIG. 1 PRIOR ART
FIG. 1 illustrates a front cutaway view taken through the axis of shotgun slug ammunition of the prior art.

Referring to FIG. 1, a representative loaded shotgun cartridge 10 of the prior art is shown. The loaded cartridge 10 includes a conventional shotgun cartridge case 20. The case 20 includes a primer 5, a brass 26, and a base wad 24. Above the base wad 24, the case 20 is loaded with a powder propellant 42, a cushioning wad 12, and a slug 30. The loading is completed by a rolled crimp 22 in the case 20. The slug 30 includes a cylindrical rotation ring or spinning band 31. The slug point 32 extends from the rotation ring 31. The slug point 32 is conical with a triangular cross-section.

Figure 2:
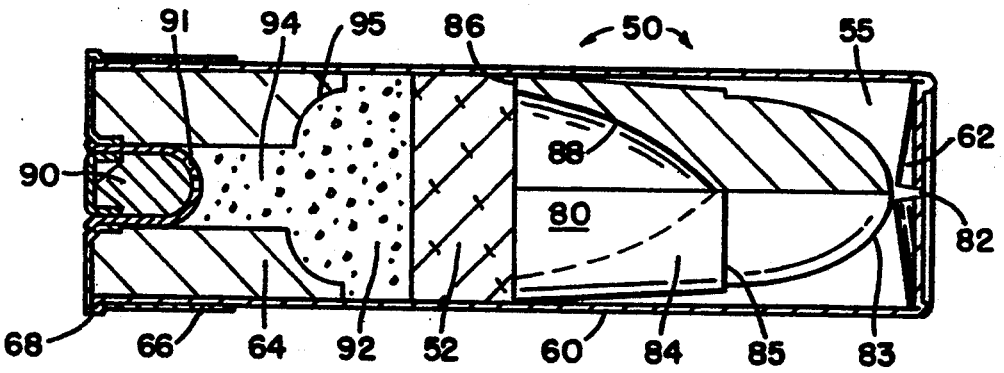
FIG. 2 is a partial cutaway of a loaded shotgun slug cartridge embodying principles of a first embodiment of the present invention.

As best seen in FIG. 2, a loaded shotgun skeet shell 50 is depicted. The skeet shell 50 includes a cartridge case 60. One end of the case 60 includes a brass 66 having a case rim 68 on the outside of the case 60. The center of the brass 66 includes a primer 90 which extends upwardly into the powder well 94. The well 94 is centrally formed in the base wad 64. The base wad 64 is generally polyformed of a synthetic material, such as plastic. Extending from the primer 90, the well 94 opens outwardly such that the powder 92 extends the entire inside diameter of the case. The well structure 94 is important to the speed and distribution of the burning powder 92. Opposite the well 94, a fiber cushion wad 52 is adjacent the powder 92. The cushion wad 52 absorbs the quick expansion of combustion gases to ease the slug 80 out of the case 60.

The slug 80 includes a nose 83 and a frustoconical rotation ring or spinning band 84. The rotation ring 84 has a base 86 and a rim 85. The smooth rotation ring 84 tapers gradually inwardly from the base 86 toward the rim 85. Internally, the rotation ring 84 includes a ogive-shaped cavity 88. The ogive-shaped cavity 88 provides for the slug 80 having a forwardly displaced weight distribution. The nose 83 of the slug includes a parabolic cross-section which ends in a tip or point 82. The overall configuration of the slug 80 more closely resembles a conventional rifle bullet than does the slug 30 of the prior art. The bullet shaped slug 30 has less drag than the more blunt nosed slug 30 and thus a farther trajectory.

The slug 30 used in the present invention is formed from 60% Sn (tin) and 40% Pb (lead). The weight of the slug can be varied depending on the percentage metal used therein.

Figure 3:
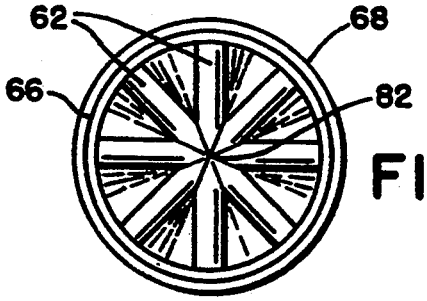
FIG. 3 is a top view of a loaded shotgun slug cartridge embodying principles of the present invention.

Above the tip 82, the case 60 has an eight-star crimp 62 (FIGS. 2 and 3). The eight-star crimp 62 is important for centering the slug 80 into the setup. The prior art casing 20 includes a full crimp 22 which does not offer the same type of centering of the slug into the setup. As seen in FIG. 3, the top view illustrates the perforations of the eight-star crimp 62. The eight-star crimp 62 is a continuation of the same plastic material of the case 60. As seen from the top view, concentrically outward from the eight-star crimp 62, the brass 66 and case rims 68 are shown.

Figure 4:
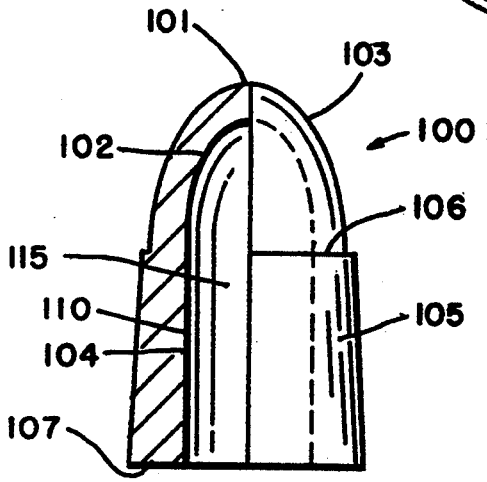
FIG. 4 is a partial cutaway of a shotgun slug embodying principles of a second embodiment of the present invention.

FIG. 4 illustrates a modified embodiment of the slug of the present invention. The slug 100 includes a smooth frustoconical rotation ring 105 and a nose 103. The rotation ring 105 has an external taper which extends inwardly from the base 107 toward the rim 106. Internally, the slug 100 has a different shape than the ogive cavity 88 of slug 80. Compared to slug 80, slug 100 has more of a rearward weight distribution. Such a modification gives the slug or projectile 100 improved accuracy at longer ranges, e.g. 300 meters. The internal cavity 115 of the slug 100 includes a lower cylindrical portion 110 and an upper parabolic portion 102.

Figure 5:
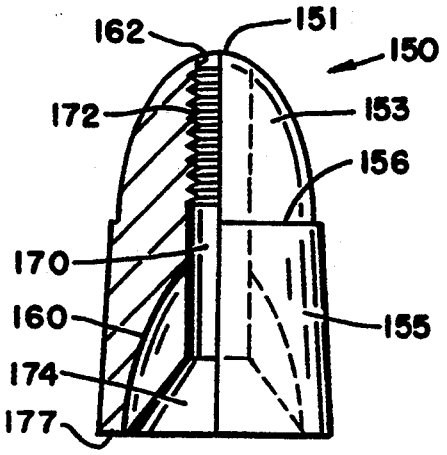
FIG. 5 is a partial cutaway of a shotgun slug embodying principles of a third embodiment of the present invention.

FIG. 5 shows a modification of the embodiment in FIG. 2 which has been adapted for armor piercing. The slug 150 includes a nose 153, a smooth frustoconical rotation ring 155, and an ogive-shaped cavity 160. An armor-piercing screw 170 is shown inserted into cavity 160. In one conventional method, a hole 162 is drilled into the cavity 160 through the slug point 151. A tool (not shown) engages screw head 174 to turn screw 170. As the screw 170 turns, threads are tapped into the hole 162 using screw threads 172. The screw 170 is formed from a hard carbon steel. Although a screw 170 has been illustrated, other hard cores may be formed, such as depleted uranium. A hard core controls the expansion of the slug upon impact. A hard cored slug is thus able to penetrate armor, whereas a slug without a hard core would have its energy dissipate outwardly into the armor upon impact.

Upon firing, the firing pin of the shotgun (not shown) strikes the primer 90. The priming mixture is crushed between the firing pin indentation in the primer head, and the anvil (inside the primer 90). The priming compound then explodes through the flash hole 91 of the primer into the powder chamber 95.

After the powder 92 is ignited by the primer 90, the quick expansion of the explosive combustion gases seeks escape from the powder chamber 95 producing a shock wave against the fiber wad 52. The fiber wad 52 begins movement, but also cushions the shock wave thereby slowing down the movement of the slug 80 out of the case or hull 60 and into the set up of the barrel (not shown). Without the cushioning effect of the fiber wad 52, the slug 80, 100, 150 would move too quickly into the set up of the barrel and an unacceptable amount of metal would be stripped off the slug 80, 100, 150. The stripping of metal from the slug would decrease the effectiveness of the slugs aerodynamic properties as well as lessening the life of the barrel.

Another important function of the wad 52 is the pressure point at which it gives way. This is largely determined by the wad's construction and/or the amount of pressure on the wad 52 when it is placed into position in the case 60. Should the wad 52 give way too quickly, the slug 80 would be released prematurely, not allowing sufficient force behind it to insure proper performance. A high pressure behind the wad 52 can also be detrimental. A high pressure would create jamming of the slug into the set up or possibly an explosion.

The crimp type used in the ammunition is also important for release of the slug into the set up. The top of the skeet hull 60 includes an 8-star crimp 62 (FIGS. 2 and 3). The conventional shotgun slug 20 is loaded with a rolled crimp 22 (FIG. 1). The 8-star crimp 62 helps ease and center the slug 80, 100, 150 into the set-up of the shotgun as the crimp 62 is opened. If a rolled crimp is used, too great of a pressure is created and the slug 80, 100, 150 does not become properly centered in the set up.

It is important that the slug 80, 100, 150 be located under the 8-star crimp 62 and not project outwardly therefrom. If the slug 80, 100, 150 were to project outwardly above the 8-star crimp 62, in some jurisdictions, it would be legally classified as a rifle bullet.

The slug 80, 100, 150 of the present invention differs from the conventional slug 30 (FIG. 1) in that it includes a slight taper on its rotation ring 84, 105, 155. The rotation ring is conventionally the cylindrical portion of the slug that engages the rifling of the barrel upon firing and causes the slug to rotate. Thus, in actuality the slug 80, 100, 150 includes a smooth frustoconical rotation ring 84, 105, 155. The smooth frustoconical rotation ring 84, 105, 155 is larger on the base 86, 107, 177 than on the rim 85, 106, 156 immediately adjacent the slug's nose 83, 103, 153. For a slug used in a 0.20 gauge shotgun, the base 86, 107, 177 of the frustoconical section is 0.615 inches at X and tapers inward to about 0.613 inches at Y, with a 0.001 inch tolerance on the rotation ring's rim 85, 106, 156. The smooth frustoconical taper has been exaggerated in the drawings for illustration purposes only. The bore of a 0.20 gauge shotgun is 0.615 inches. Rifling decreases the bore size of the barrel to 0.608 to 0.607 inches from land to groove. Since the rotation ring 84, 105, 155 is larger than the rifled bore, its slight taper allows for the slug 80, 100, 150 to center into the setup with minimal disturbance or play upon firing. If the slug 80, 100, 150 is not centered going into the setup, excessive swagging would occur in the rifling and the pressure spike on entering barrel would be reduced. Also, the barrel would require frequent cleaning.

The slug 80, 100, 150 is used almost exclusively with a 0.20 gauge shotgun. However, it may be modified for use with a 0.410, 0.28, 0.24, or 0.16 gauge shotgun. The slug 80, 100, 150 may not be modified for use in a 0.12 gauge shotgun without modification of the gun because the slug would need to weigh a minimum of two ounces. A two ounce slug would create too great a pressure spike during firing.

Conventional shotguns on the market today have relatively short ranges and thus will not make claims of accuracy at over 100 yards. The slug of the present invention is about 300 to 375 grains heavier than the conventional 0.20 gauge slug. Brenneke produces a $\frac{5}{8}$ ounce or 273 grain slug for a 0.20 gauge shotgun, whereas the slug of the present invention is about 583 to 648 grains or $1\frac{1}{3}$ ounces to $1\frac{1}{2}$ ounces depending upon the percentage of the metal content. The conventional 0.20 gauge shotgun ammunition obtains an exit velocity from the barrel at 1100 to 1150 ft/sec for a $\frac{5}{8}$ ounce slug. Under the same firing conditions, the present slug has a 1250 ft/sec velocity. Variations in firing conditions, such as barrel length, type of powder, can vary the exit velocity of the present invention from 850 ft/sec to 1350 ft/sec.

As a result of the difference in exit velocity of the present invention, as opposed to the prior art, the slug of the present invention has a 6" rise at 100 yards, whereas the best prior art slugs have a 2" drop at 100 yards. This means that the trajectory of the slug of the present invention has not yet reached its zenith at 100 yards, whereas the prior art slug's trajectory is on the decay. The slug of the present invention reaches its zenith at between 175 to 200 yards. At 300 meters, using a model 37 Ithica shotgun with a 25 inch rifled barrel, having replacement iron sites, about a 17 inch by 20 inch grouping is obtained. At 100 meters a 10 inch by 10 inch grouping is obtained. Such grouping is sufficient for hunting, military, and police applications.

The embodiments disclosed herein have been discussed for the purpose of familiarizing the reader with the novel aspects of the invention. Although preferred embodiments of the invention have been shown, many changes, modifications and substitutions may be made by one having ordinary skill in the art without necessarily departing from the spirit and scope of the invention as described in the following claims.

I claim:

1. Ammunition for use in a shotgun comprising:

a cartridge including a powder chamber and a powder well;

shotgun propellant positioned within said powder chamber and said powder well of said cartridge;

a resilient wad positioned within said cartridge and said powder chamber; and a sabot-free, round nose slug having a frustoconical rotation ring and an internal cavity, said rotation ring including a base and a rim and having a smooth outer periphery for engaging the rifling of said rifled shotgun upon firing, wherein the diameter of the base is larger than the diameter of the rim, and wherein said cartridge includes a crimp projecting inwardly above the nose of said slug.

2. The ammunition of claim 1, wherein the internal cavity of said slug is ogive-shaped.

3. The ammunition of claim 2, including a screw extending through said cavity.

4. The ammunition of claim 1, wherein the internal bore of the slug has a cylindrical portion and a parabolic portion.

* * * * *